US005268548A

United States Patent [19]

Kumar

[11] Patent Number: 5,268,548

[45] Date of Patent: Dec. 7, 1993

[54] MICROWAVE ASSISTED PAINT STRIPPING

[75] Inventor: Ashok Kumar, Champaign, Ill.

[73] Assignee: The United States of America as represented by the Secretary of the Army, Washington, D.C.

[21] Appl. No.: 880,261

[22] Filed: May 8, 1992

[51] Int. Cl.[5] ..... H05B 6/64

[52] U.S. Cl. ..... 219/10.55 M; 219/10.55 A; 219/10.57; 134/38; 204/146; 252/502; 427/286

[58] Field of Search ..... 219/10.55 M, 10.55 A, 219/10.57; 134/38; 204/146; 427/286; 252/502, 506

[56] References Cited

U.S. PATENT DOCUMENTS

| | | | |
|---|---|---|---|
| 3,469,053 | 9/1969 | Levinson | 219/10.55 E |
| 3,999,040 | 12/1976 | Ellis | 252/506 |
| 4,588,885 | 5/1986 | Lovoi et al. | 134/38 |
| 4,756,765 | 7/1988 | Woodroffe | 134/38 |
| 4,816,289 | 3/1989 | Komatsu et al. | 252/502 |

*Primary Examiner*—Bruce A. Reynolds
*Assistant Examiner*—Tu Hoang
*Attorney, Agent, or Firm*—Luther A. Marsh

[57] ABSTRACT

A method of removing paint and other coatings from large and small substrate structures includes applying to the surface of the structure a compound capable of coupling with microwave radiation in the wavelength range $10^{-3}$ to 0.3 meters for causing pyrolysis of the paint.

8 Claims, No Drawings

MICROWAVE ASSISTED PAINT STRIPPING

FIELD AND HISTORICAL BACKGROUND OF THE INVENTION

The present invention is directed to removing paint from large substrates or structures, such as aircraft, buildings, metallic locks and dam gates, by pyrolysis using microwave coupling compounds which are sprayed on the structure.

Several conventional methods of paint removal are used, such as mechanical scraping/grinding, abrasives, blasting, blow torching, etc. These methods are, however, used on buildings and are labor intensive. In older housing structures lead based paint has been used which needs to be removed safely.

In addition, chemical strippers containing methyline chloride, phenol and formic acid are effective in paint removal in the metal finishing industry. However, the use of toxic organics is limited by EPA regulations to 2.13 mg/1 of waste effluent, and methylene chloride and phenol are recognized as hazardous.

Fluidized bed paint stripping and sludge burning is accomplished by using a fluid bed furnace heated to 800 degrees F. to pyrolyze the paint. The fluidized bed furnace is filled with aluminum oxide as the fluidized medium. Items to be stripped are suspended in a loading frame on a basket. The bed is fluidized using air and 150 mesh solids of $Al_2O_3$. The load of painted articles is typically held in the fluidized furnace for 30 minutes. Under these conditions, most of the organic material is pyrolyzed to hydrocarbon gas because there is insufficient oxygen available for combustion. This method is not effective for large structures because it involves immersion of the part in the furnace. The size of the part to be stripped is therefore limited by the size of the furnace.

Another process for removing carbonizable adherent coating on the surface of metal parts is heating the part to carbonizing temperatures and blasted with heated blasting agents. Then the parts are cooled in liquid nitrogen to cause embrittlement of the carbonized coating. This process is used to remove paint from electric cables and from hangers for automobile printing. This process is also limited by the size of the retort and can not be used on large structures.

Aircraft are painted for several reasons, such as, a. Protection from corrosive atmospheres;
b. Aesthetic reasons as well as informational record;
c. Camouflage;
d. Radar suppression; and
e. IR suppression.

Some of these aircraft must be stripped of paint and repainted every two to three years for, a. Inspection of the extent of corrosion;
b. Paint damage repair;
c. Change of top coat systems; and
d. Removal of weathered paint.

For some aircraft structures made from polymeric composites, such as helicopter rotors, hand or power tool scraping is required because of close tolerances.

Stripping of old paint from an aircraft is accomplished by coating the aircraft with a chemical stripping compound and scrubbing it off. This method yields a hazardous sludge which must be sealed in barrels and then buried in landfills. The increased difficulty in finding landfill areas as well as the large cost associated therewith contributes to high cost of paint stripping.

OBJECTS AND SUMMARY OF THE INVENTION

The principal object of the present invention is to provide a novel method of removing paint from various structures, especially large structures, such as aircraft, buildings, dam gates, etc.

Another object of the present invention is to provide a novel method of removing paint by pyrolysis which is environmentally more acceptable than chemical paint stripping methods.

Yet another object of the present invention is to provide a novel method of removing paint from substrates which is less labor intensive than mechanical stripping, for example.

An additional object of the present invention is to provide a novel method of stripping paint from substrates which has the advantage of rapid heating, precise control of temperature and selective heating of the outer paint layer by microwave energy.

Yet an additional object of the present invention is to provide a novel method of removing paint which can be effectively used in removing paint from large, as well as small structures, such as metallic locks.

In summary, the main object of the present invention is to provide a novel method of removing paint from small as well as large structures which method is less labor intensive, and environmentally safe, and allows precise control of temperature and selective heating of the paint layer by using microwave energy.

DETAILED DESCRIPTION OF THE INVENTION

In this process, the part to be stripped, be it an airplane, building or a dam/lock gate, is sprayed with a strong microwave coupling compound. Some of these compounds are listed below in Table 1. These compounds readily obtain temperatures of the order of 2500 degrees F. within minutes when coupled with microwave energy.

TABLE 1

| Microwave Coupling Compounds | | |
|---|---|---|
| Chemical | Temperature (C.) | Time (Minutes) |
| $MnO_2$ | 1287 | 6 |
| NiO | 1305 | 6.25 |
| $WO_2$ | 1270 | 6 |
| $CO_3O_3$ | 1290 | 3 |
| Carbon | 1300 | 1 |
| $F_eT_iO_3$ | 1200 | 3 |

In this process, the compound is sprayed on the surface in the form of a slurry.

The sprayed surface is then exposed to microwave energy which causes pyrolysis to occur. Preferably, a portable microwave radiation emitting oven is designed to scan the surface of the structure. The microwave fixture has metallic sides and accordion structure.

The microwave energy will heat the compound within minutes to the desired temperature ranging from about 1100 degrees C. to about 1400 degrees C. The temperature can easily be controlled as it is a rapid process and only the top layer of paint is heated. No damage to the substrate occurs.

Paint on wood, concrete or metal substrates can be decomposed/pyrolyzed and stripped using microwave coupling compounds. Overlays of sprayed on materials, such as those shown in Table 1 can be used. Once the paint is heated, the paint which contains pigments and binders may couple with the microwaves and pyrolyze. The intense heat can be used to decompose the paint layer. The wavelength of the microwave radiation can be varied from $10^{-3}$ to 0.3 meters. Various materials absorb energy from microwaves by ionic conduction, dipole rotation, dipole stretching, ferroelectric hysterisis, magnetostriction, ferromagnetic resonance, electrostriction, domain wall resonance and other mechanisms. At higher temperatures, the energy absorbed is increased for polymers because the relaxation frequency of the polymer molecule gets closer to the microwave frequencies. Once the paint is pyrolyzed it can be removed with a vacuum cleaner or by other means.

If the painted part is small, it can be placed in a factory microwave radiation emitting oven. Otherwise, a portable microwave radiation emitting oven is mounted on tracks and can fit snugly on the structure is used. A small microwave oven can be used which is track mounted to scan the larger structure, such as an aircraft or a building.

While this invention has been described as having a preferred method, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

What is claimed is:

1. A method of removing a coating from a substrate, comprising the steps of:

a. providing a substrate with a coating thereon;

b. providing radiation emitting means for emitting electromagnetic radiation having wavelengths in the range from about $10^{-3}$ to about 0.3 meters;

c. applying to a preselected area of said substrate a compound capable of coupling with said electromagnetic radiation;

d. exposing said preselected area of said substrate with said coupling compound to said electromagnetic radiation for a time sufficient to cause pyrolysis of said coating; and, e. removing the coating from said substrate.

2. The method of claim 1, wherein, said coupling compound is selected from the group consisting of $MnO_2$, NIO, $WO_2$, $CO_3O_3$, C and $F_eT_iO_3$.

3. The method of claim 1, wherein, said exposing step is carried out from about 1 to about 6 minutes.

4. The method of claim 1, wherein, said preselected area of said substrate is heated to a temperature of from about 1100 degrees C. to about 1400 degrees C. during said exposing step.

5. The method of claim 1, wherein, said exposing step includes translating said radiation emitting means relative to said preselected area of said substrate.

6. The method of claim 1, wherein, said coating comprises a paint material.

7. The method of claim 1, wherein, said coupling compound is applied in the form of a slurry.

8. The method of claim 1, wherein, said coating removing is accomplished by a vacuum cleaner.

* * * * *